US007063380B1

(12) United States Patent
Cui

(10) Patent No.: US 7,063,380 B1
(45) Date of Patent: Jun. 20, 2006

(54) COLLAPSIBLE EASY CHAIR

(76) Inventor: Zhongmin Cui, Room 104, No. 5 Guotai Lane, Zhejiang Province (CN)

( * ) Notice: Subject to any disclaimer, the term of this patent is extended or adjusted under 35 U.S.C. 154(b) by 0 days.

(21) Appl. No.: 11/179,354

(22) Filed: Jul. 12, 2005

(30) Foreign Application Priority Data

Dec. 24, 2004 (CN) ..... 2004 1 0099054

(51) Int. Cl.
*A47C 4/00* (2006.01)

(52) U.S. Cl. ..... 297/30; 297/25; 297/35; 297/39; 297/46

(58) Field of Classification Search ..... 297/30, 297/24, 25, 29, 35, 39 X, 40, 46
See application file for complete search history.

(56) References Cited

U.S. PATENT DOCUMENTS 2,571,463 A * 10/1951 Lorenz ..... 297/29
2,710,645 A * 6/1955 Luckhardt ..... 297/38
5,570,926 A * 11/1996 Papiernik et al. ..... 297/39
6,755,463 B1 * 6/2004 Lardieri et al. ..... 297/35
6,902,231 B1 * 6/2005 Tseng ..... 297/27

* cited by examiner

*Primary Examiner*—Laurie K. Cranmer
(74) *Attorney, Agent, or Firm*—Lumen Intellectual Property Services, Inc.

(57) ABSTRACT

This invention discloses a leisure time use easy chair, especially for use in the garden or camping. The chair includes a back, a seat, and a leg rest, with a piece of fabric stretched over the surfaces being formed by these elements, a pair of armrests, and a base with front and rear legs. The chair further includes a transverse link between the front and rear legs. This link has a sliding locking mechanism to maintain a certain incline angle of the back and the leg rest. The position of the sliding mechanism decreases the risk of harm to the user's fingers. In addition, the chair is fully collapsible. The object of the present invention is firstly to solve the problem of safety, and secondly to provide an esthetic and more comfortable easy chair.

11 Claims, 4 Drawing Sheets

COLLAPSIBLE EASY CHAIR

CROSS-REFERENCE TO RELATED APPLICATIONS

This application claims priority from Chinese Application No. 200410099054.4, filed Dec. 24, 2004, which is incorporated herein by reference.

FIELD OF THE INVENTION

The present invention relates generally to an easy chair. More particularly, the present invention relates to an easy chair of the type comprising a back and a leg rest, which both can be folded and inclined, making the chair easy to carry and store away.

BACKGROUND

Easy chairs are a type of chair that is suitable for leisure time use, especially in the garden or camping. These chairs include a back, a seat, and a leg rest, with a piece of fabric stretched over the surfaces formed by these elements. They can both be folded and inclined freely.

U.S. Pat. No. 5,570,926 discloses one such chair, which is illustrated in FIG. 5. As shown in FIG. 5, this chair comprises a frame forming a back 1; two parallel side members 2 forming a seat, which are articulated in the vicinity of the lower end of back frame 1; a U-shaped frame forming a leg rest 3; two leg units 35 and 36; and a quadrilateral formed by the back, the leg rest, the side member of the seat and a sliding rod 5 of an armrest 4, on which there is a sliding fork yoke 7 slidably disposed over the sliding rod 5 for locking and maintaining an inclined back angle of the chair. When a user sits on the chair and adjusts the incline of the back 1, the entire base formed by front and rear leg units 36 and 35 as well as the sliding fork yoke 7, which is fixed at the top place of the front leg 36, is stationary. In contrast, the sliding rod 5 moves within the sleeve of the sliding fork yoke 7. Because the sliding fork yoke 7, with a locking means 8 thereon, is placed too close to the user's hand, it would hurt the user's hand when the user adjusts the back incline angle or when the user opens or closes the easy chair. It is not safe for use when transmission of movement between the back 1 and the leg rest 3 takes place, because the sliding fork yoke 7 is stationary while the sliding rod 5 slides due to the back rotating around hinge 24, which is located on the lower end of the back frame 3 for articulating with the armrest. The manipulations for adjusting incline angle may lead to biting of the user's fingers.

Moreover, in order to adjust the incline of the back 1 and the leg rest 3, there is a need to set several adjustment screws (not shown) over the sliding tube 5 underneath the armrest 4, because the sliding fork yoke 7 is placed in an improper position. Thus, the configuration of the armrest 4 is not neat and has an ugly and random looking appearance. The position of the sliding fork yoke 7 is undesirable. Accordingly, there is a need in the art to develop an easy chair with a more desirable sliding fork position.

SUMMARY OF THE INVENTION

The object of the present invention is to overcome the deficiencies existing in the above-mentioned prior art, firstly by solving the safety problem and secondarily by providing a more esthetic and more comfortable easy chair, by providing an easy chair which is easy to set up and fold flat and which won't harm the user's fingers. The present invention overcomes the above-mentioned disadvantages by providing such a chair.

The present invention provides an easychair including:

a back having articulated points at lower end thereof, preferably having a rectangular frame shape and a curved integral surface;

a seat having a pair of parallel side members, wherein the side members are articulated to the lower end of the back frame via a hinge point;

a pair of armrests, parallel with each other, wherein each armrest includes a cover plate that rests over a tubular metal element underneath the cover plate, and wherein the armrests are articulated with the back frame via a hinge joint;

a leg rest having a U-shaped frame, wherein the U-shaped frame includes a pair of parallel braces, and wherein each brace's top end is articulated to one of the armrests via a hinge joint and is further articulated to one of the side members of the seat via another hinge joint;

and a base formed by a front leg unit and a rear leg unit, wherein each of the leg units has a pair of parallel braces (legs), and the front leg unit is articulated with the rear legs via a welded forked yoke thereon. The tops of the braces of the rear leg unit have hinge joints providing an articulation connection with the armrest and a support therefore. A transverse link is disposed between the front leg unit and the rear leg unit, and there is a sliding forked yoke thereon. The transverse link has several holes thereon for insertion by stop pins, to limit incline and to maintain an unchanging incline angle. Each different stop pin's position provides an inclined angle limitation for the back and the leg rest. The sliding forked yoke has an eccentric cam type lock for maintaining a certain incline angle of the back and the leg rest. The sliding forked yoke includes a sleeved body that integrally has a fastening plate for providing a fixed connection with the side member of the seat via a hinge joint. The sleeve has an eccentric rotating lock member positioned in the center part thereof. The transverse link at its one end has a hinged connection with the pair of braces of the front leg unit via a welded forked yoke, and at the other end thereof it slidingly engages the rear leg unit via a guiding forked yoke. The guiding forked yoke includes a guiding sleeve having a pivoted connection member for providing a terminal connection with the transverse link. The guiding sleeve has the freedom to move in a path that traces the profile of the rear leg unit.

In order to bear the weight of a user, the sliding forked yoke has a fixed hinge joint with the side member of the seat for providing support to the seat. Between the base and the seat there is a two-point contact, namely, on one hand the sliding forked yoke, and on the other hand the hinge joint between the armrest and the top end of rear leg unit. The weight of the user is supported by the two above-mentioned points. The leg rest, the back frame, and the side members of the seat define a surface. A piece of fabric is secured to the easy chair and disposed across this surface.

A quadrilateral is formed by an armrest, the lower end of the back frame, a side member of the seat and the upper part of the leg rest. Its deformation determines the inclined angle of both the back frame and the leg rest.

All elements forming the back frame, the side members of the seat, the leg rest, the armrest, the front leg unit, and the rear leg unit are tubular metal elements.

The operation of the present invention is as follows:

Since the transverse link is articulated about the front leg unit by means of a pivot pin, when two leg units, i.e., the front and rear legs of the base, are folded together, the guiding forked yoke is pushed toward the bottom of the rear leg unit. Simultaneous with this downward movement, the guiding forked yoke makes the lower left corner of the quadrilateral go downward to the bottom of the rear leg unit, thus causing the quadrilateral to go flat. This result is illustrated in FIG. 4, which shows the chair folded completely flat. The chair is set up again by carrying out the above operation in reverse.

BRIEF DESCRIPTION OF THE FIGURES

The present invention together with its objectives and advantages will be understood by reading the following description in conjunction with the drawings, in which.

DETAILED DESCRIPTION OF THE INVENTION

Figure 1:
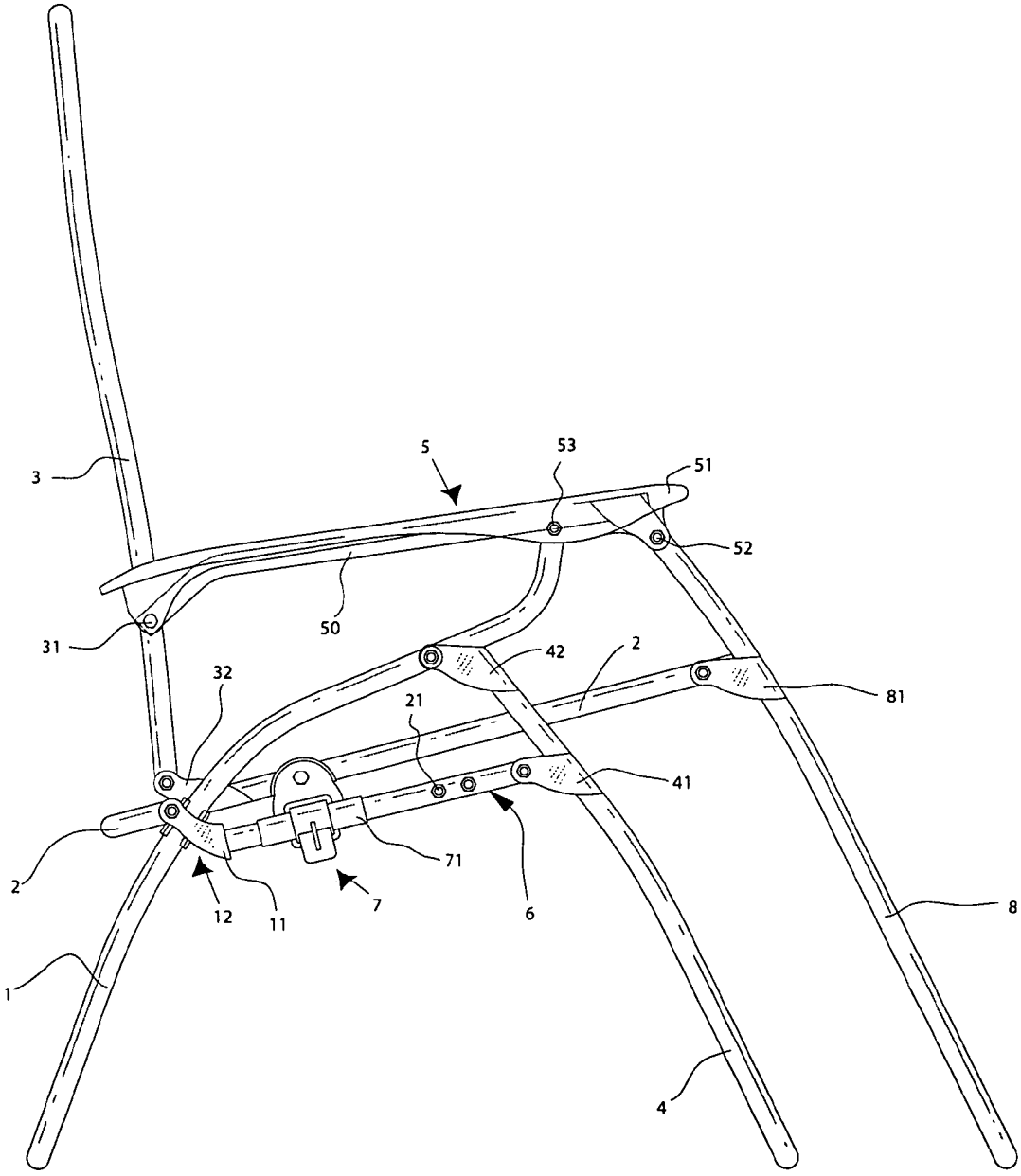
FIG. 1 is a side view of the easy chair of the present invention in setup position.

The easy chair of the present invention is shown in FIG. 1 in its set-up position. The easy chair includes:

a back frame 3 having articulated hinge joints 31 and 32 at lower end thereof, wherein the frame 3 has a rectangular shape, and wherein the frame 3 has a surface that can be inclined backwardly by rotating about the hinge joint 31;

a seat formed by a pair of parallel side members 2, wherein the members 2 are articulated to the lower end of the back frame 3 via hinge joint 32, and wherein the front ends of the side members 2 are connected with a brace of leg rest frame 8 via welded forked yoke 81;

a pair of armrests 5, which are parallel to each other, wherein each armrest includes a resting cover plate 51 and a tubular metal element 50 underneath the resting cover plate 51 that supports resting cover plate 51, wherein the armrests are articulated with back frame 3 via hinge joint 31, wherein the front ends of the armrests are pivotally connected with the top end of a brace of the leg rest frame 8 via a welded forked yoke 52 thereon, wherein the armrests are connected with the top end of a leg unit 1 via a hinged joint 53, and wherein the resting cover plate 51 has downward curved margins to hide the hinged joint 53 and welded forked yoke 52;

a leg rest having a U-shaped frame 8, the U-shaped frame 8 including a pair of parallel braces, wherein each brace's top end is articulated to one of said armrests 5 via a welded forked yoke 52 and is further articulated to one of said side members 2 via a welded forked yoke 81;

a base formed by a front leg unit 4 and a rear leg unit 1, wherein each leg unit has a pair of parallel legs, wherein each leg of the front leg unit is articulated with a leg of the rear leg unit via a welded forked yoke 42, and wherein the tops of the rear legs have hinge joints 53, which provide an articulation connection with an armrest 5 and provides support therefore.

Figure 2:
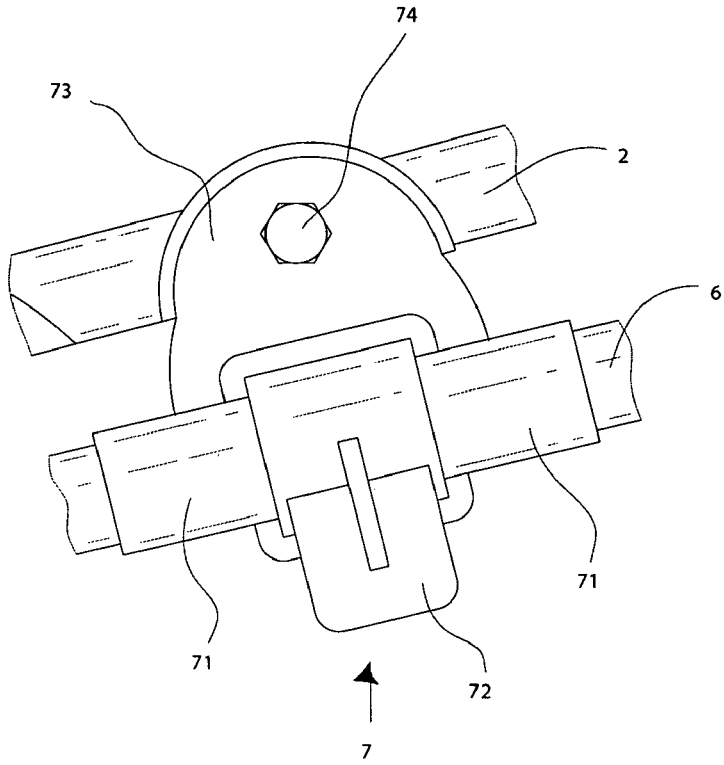
FIG. 2 is a local enlarged drawing of the sliding forked yoke.

A transverse link 6 is disposed between the front leg unit 4 and rear leg unit 1, which has one end hinged with a pair of legs of the front leg unit 4 via a welded fork yoke 41, which is welded on the leg of front leg unit 4, and the other end slidingly engaging the rear leg unit 1 via guiding fork yoke 12. Over transverse link 6 there is a sliding forked yoke 7 with an eccentric-type cam lock 72 thereon (see FIG. 2) configured to slide along link 6, and which is secured on a pair of side members 2 of the seat by means of a fastener 73 for providing a support to the seat. The transverse link 6 has several holes 21 for being inserted by a stop pin (see FIG. 1) to stop unwanted movement of the sliding forked yoke 7 while the user is sitting on the chair, and to maintain an unchanging incline angle. The sliding forked yoke 7 includes a sleeved body 71 that integrally has a fastener plate 73 for providing a fixed connection with side member 2 of the seat via hinge joint 74. The sleeve 71 has an eccentric-type cam rotating lock member 72 positioned in the center part thereof. The incline of the chair is maintained by locking the transverse link 6 in the sliding forked yoke 7, with the locking action provided by rotating the eccentric lock 72.

Figure 3:
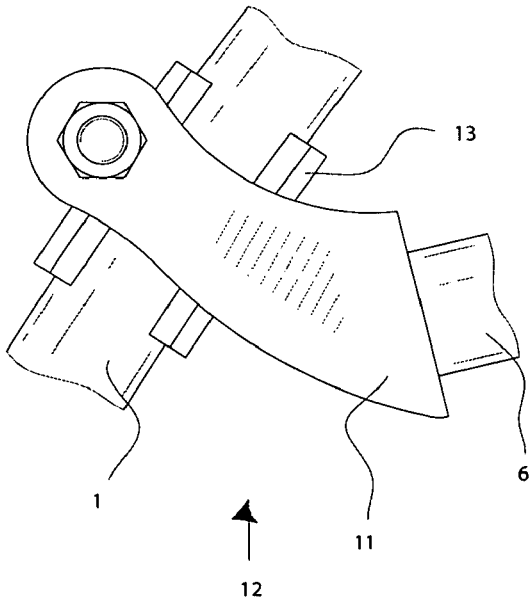
FIG. 3 is a local enlarged drawing of the guiding forked yoke.

The guiding forked yoke 12 includes a guiding sleeve 13, which has a pivotal sleeve-like connection member 11 for providing a terminal connection with the transverse link 6 (see FIG. 3). The guiding sleeve 13 can freely move in a path tracing the profile of the brace of rear leg unit 1.

There are four articulations 31, 32, 51, 81 that represent four corners of a quadrilateral which is formed of armrest 5, the lower end of back frame 3, side member 2 of the seat and the upper end of the leg rest 8. Deformation of the quadrilateral determines the inclined angle of both back frame 3 and leg rest 8.

All elements forming the back frame 3, side members 2 of the seat, the leg rest 8, armrest 5, front leg unit 4, and rear leg unit 1 are tubular metal elements.

The welded forked yokes 42 and 41 are welded on a pair of braces of the front leg unit 4 for providing an articulated connection with rear leg unit 1 and transverse link 6, respectively. The welded forked yoke 81 is welded on the brace of leg rest unit 8 to provide an articulated connection with the side member 2. The welded forked yoke 52 is welded on tubular metal element 50 for providing an articulated connection with the top end of the brace of leg rest unit 8. The welded forked yoke 32 is welded on the side member 2 for providing an articulated connection with the back frame 3.

Figure 4:
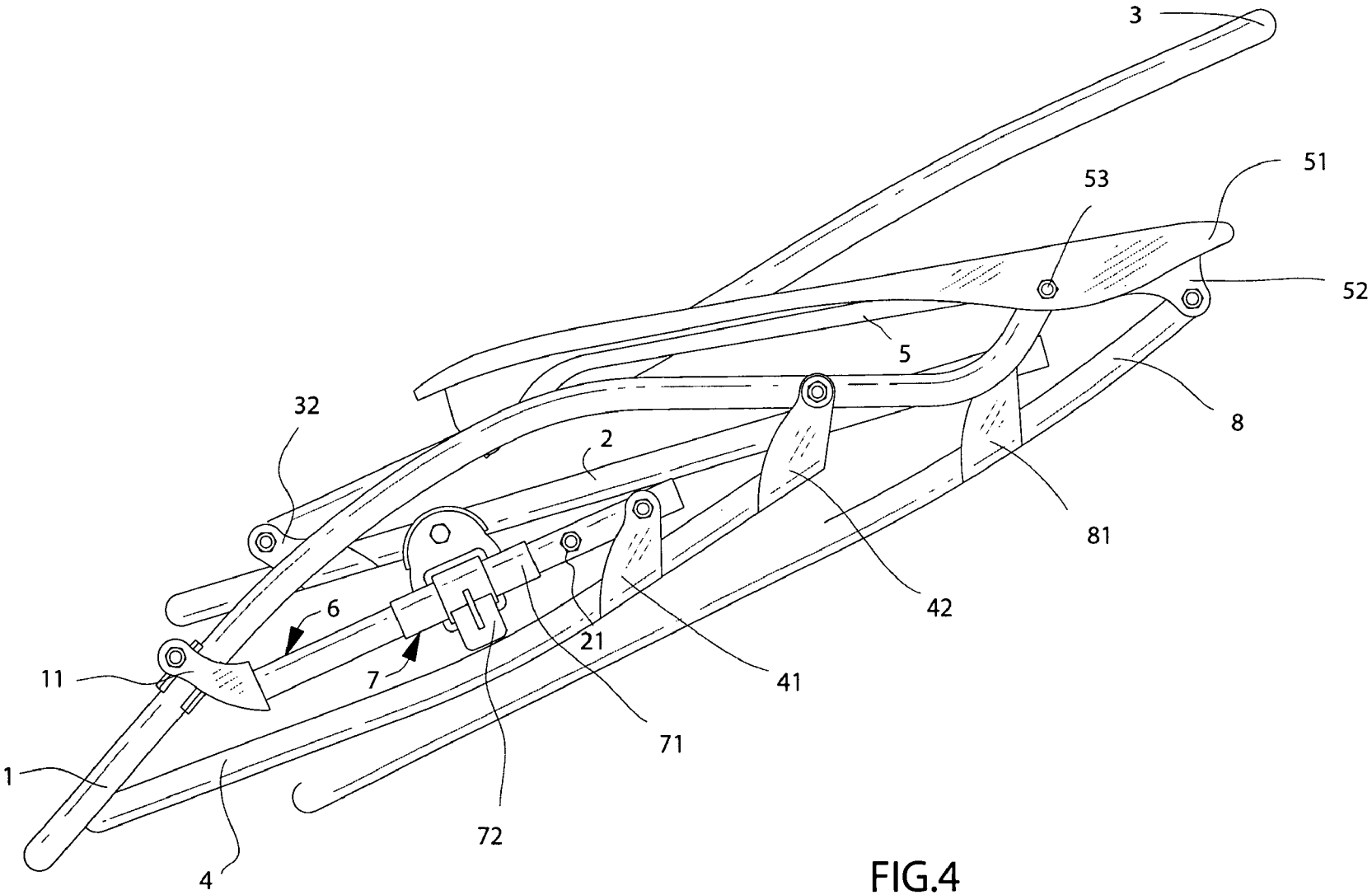
FIG. 4 is a side view of the easy chair shown in FIG. 1 in its folded-flat position.
Figure 5:
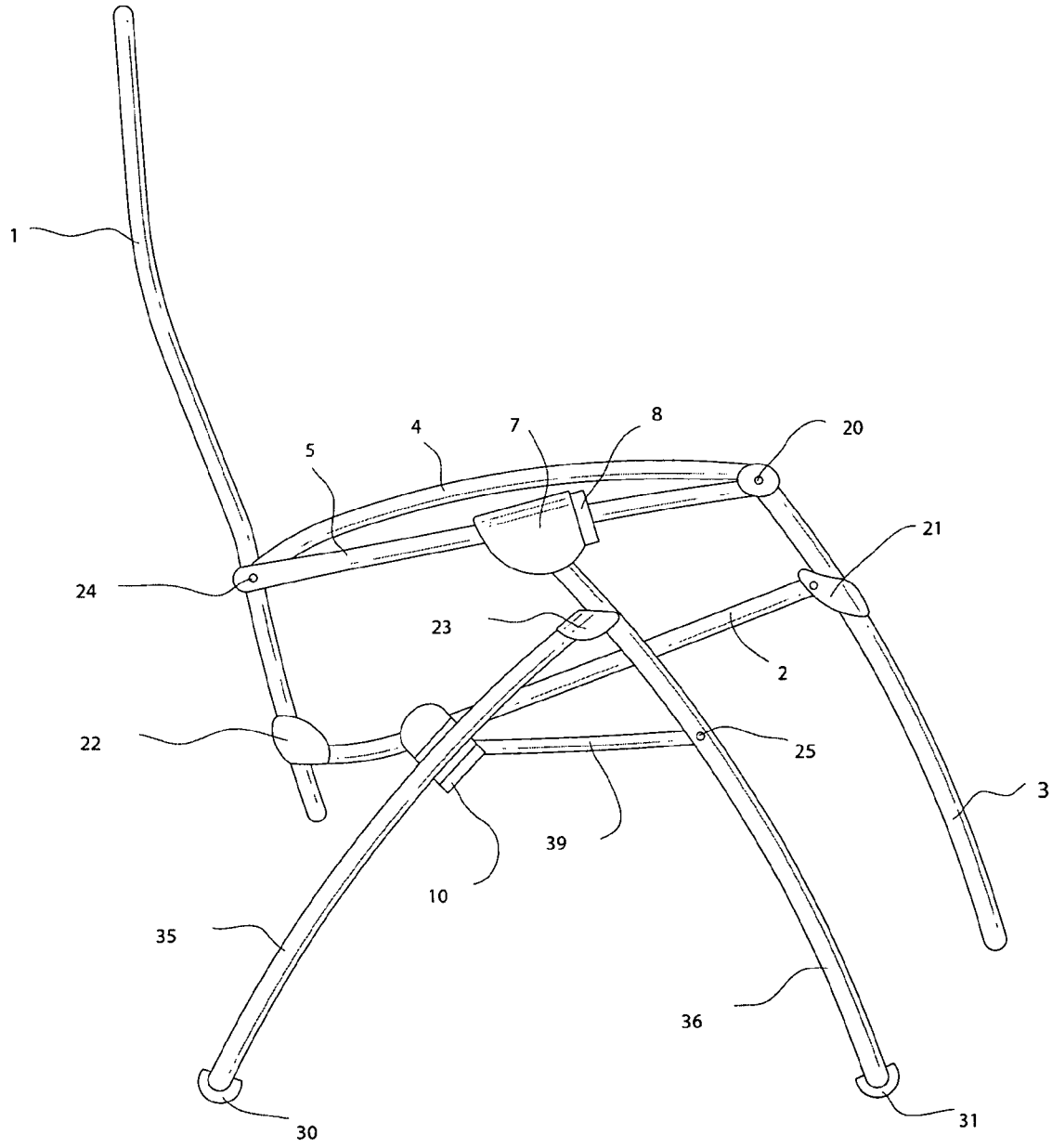
PRIOR ART FIG.5
FIG. 5 shows a side view of a chair in the art. (U.S. Pat. No. 5,570,926)

The operation of the present invention is as follows:

Since the transverse link 6 is articulated about the front leg unit 4 by means of welded forked yoke 41, when the two leg units 1 and 4 of the base are folded together, the guiding forked yoke 12 is pushed toward the bottom of the rear leg unit 1. Simultaneous with this downward movement, the guiding forked yoke 12 makes the articulation 32 (one of the corners of the quadrilateral) also go downward to the bottom of the rear leg unit 1, thus causing the quadrilateral to go flat. This result is illustrated in FIG. 4, which shows the chair folded completely flat. The chair is set up again by carrying out the above operation in reverse.

When the back is inclined backward, the articulation 31 is caused to be located further back than the articulation 32. This movement pulls the armrest 5 backward while the side member 2 is pushed forward. The sliding forked yoke 7 also goes forward due to its fixed connection with the side member 2, thus the sliding forked yoke 7 slides on the transverse link 6. To obtain a desired incline angle, after the user leans his body to push the back backward to a desired incline angle, the user then rotates the eccentric lock 72 to lock it.

Advantages deriving from the present invention include safety and the esthetic appearance of the chair. Because the sliding forked yoke 7 is removed from the armrest to a lower position, the user's hand is far apart from the yoke 7. Hence, injury caused by adjustment of the incline angle can be avoided. In addition the appearance of the chair become desirable and neat.

What is claimed is:

1. An easy chair comprising:

(a) a back having two articulated points;

(b) a seat having a pair of parallel side members, wherein said side members are articulated to a lower end of said back via a hinge point;

(c) a pair of armrests, wherein said armrests are parallel with each other and wherein each of said armrests comprises a cover plate and a tubular metal element situated underneath said cover plate;

(d) a leg rest having a U-shaped frame, wherein said U-shaped frame includes a pair of parallel braces, wherein each brace's top end is articulated to one of said ammrests via a first hinge joint, and wherein each brace is articulated to one of said side members via a second hinge joint;

(e) a base formed by a front leg unit and a rear leg unit, wherein each of said leg units comprises a pair of parallel legs, wherein said front leg unit is articulated with said legs of said rear leg unit with a welded forked yoke, and wherein tops of said legs of said rear leg unit have hinge joints that provide a connection with said armrest and a support;

(f) a transverse link disposed between said first leg unit and said second leg unit, wherein said transverse link has one end hinged with a pair of legs of said front leg unit via a welded forked yoke and another end thereof slidably engaged with said rear leg unit via a guiding forked yoke; and (h) a sliding forked yoke situated over said transverse link, wherein said sliding forked yoke has an eccentric-type cam lock configured to slide along said transverse link, and wherein said sliding forked yoke is secured on said pair of side members of said seat by means of a fastener for providing support to said seat.

2. The easy chair of claim 1, wherein said transverse link has several holes through which a stop pin can be inserted.

3. The easy chair of claim 1, wherein said sliding forked yoke has a fixed hinge joint connected with said side member of said seat for providing a support to said seat.

4. The easy chair of claim 3, wherein said sliding forked yoke has eccentric cam type locks to maintain a certain incline angle of said back and said leg rest.

5. The easy chair of claim 1, wherein there are two points of contact between said base and said seat, wherein a first point of contact is said sliding forked yokes and wherein a second point of contact is said hinge joints of said rear leg unit.

6. The easy chair of claim 1, wherein said back frame, said side members, said leg rest, said armrests, said front leg unit, and said rear leg unit comprise tubular metal elements.

7. The easy chair of claim 1, wherein said sliding forked yoke comprises a sleeved body containing a fastening plate integral to said sleeved body, wherein said fastening plate provides a fixed connection with said side member of said seat via a hinge joint, and wherein said sleeved body has an eccentric rotating lock member positioned in a center part thereof.

8. The easy chair of claim 1, wherein said guiding forked yoke comprises a guiding sleeve that has a pivotal sleeve-like connection member for providing a terminal connection with said transverse link.

9. The easy chair of claim 1, wherein said tubular metal element is articulated with said back via a hinge joint.

10. The easy chair of claim 9, wherein said cover plate has a co-joint hinge with said tubular metal element to fix said tubular metal element on a lower part of said back.

11. The easy chair of claim 9, wherein said cover plate has downward curved margins to hide said hinged joint of said rear leg unit and said welded forked yoke.

* * * * *